US006412819B1

(12) United States Patent
Paine et al.

(10) Patent No.: US 6,412,819 B1
(45) Date of Patent: Jul. 2, 2002

(54) COVER FOR A BINDING

(75) Inventors: Leslie Paine; Hugh Webb, both of London (GB)

(73) Assignee: Folders Galore Limited, London (GB)

( * ) Notice: Subject to any disclaimer, the term of this patent is extended or adjusted under 35 U.S.C. 154(b) by 0 days.

(21) Appl. No.: 09/560,329

(22) Filed: Apr. 28, 2000

(30) Foreign Application Priority Data

Apr. 30, 1999 (GB) ..... 9910013

(51) Int. Cl.[7] ..... B42D 3/00

(52) U.S. Cl. ..... 281/29; 281/21.1; 281/36; 402/73; D19/26

(58) Field of Search ..... 281/4, 15.1, 19.2, 281/19.1, 21.1, 27.1, 28, 29, 34, 36, 37, 38; 402/73, 75, 79, 80 L; D19/26, 27

(56) References Cited

U.S. PATENT DOCUMENTS 2,078,988 A * 5/1937 Amato
4,711,469 A * 12/1987 Bogar ..... 281/25 A
4,907,905 A * 3/1990 Fournier ..... 402/80 R
5,417,510 A * 5/1995 Stout ..... 402/76
5,697,646 A * 12/1997 Venegas ..... 281/37
5,725,196 A * 3/1998 Scheel ..... 281/21.1

FOREIGN PATENT DOCUMENTS

DE 94 01 383 3/1994

* cited by examiner

*Primary Examiner*—A. L. Wellington
*Assistant Examiner*—Monica Carter
(74) *Attorney, Agent, or Firm*—Clark & Brody

(57) ABSTRACT

A cover for a binding which comprises at least one looped formation to enable it to hold together a plurality of sheets of paper and which is held on or adjacent to the inside of a spine of the cover when the latter is in use. The cover has at least one tab on or adjacent to the spine of the cover, the tab having an aperture into which such a looped formation can be inserted when the cover is in use.

16 Claims, 14 Drawing Sheets

COVER FOR A BINDING

BACKGROUND OF THE INVENTION

The present invention relates to a cover for a binding which comprises at least one looped formation to enable it to hold together a plurality of sheets of paper.

One such cover which has already been proposed comprises a relatively rigid cardboard material which is often covered by paper and which has two folded lines down opposite sides of a spine of the cover so that the latter can be opened and closed. One disadvantage of such a cover is that it is either fairly bulky or, alternatively, it is rather weak so that the front and back of the cover are relatively easily urged out of true.

Another such cover which has already been proposed comprises a sheet with a multiplicity of holes punched through it in a line adjacent to an edge of the sheet, through which holes extends a continuous looped wire binding. A disadvantage of this previously proposed construction is that the binding remains in view and unsightly, and can easily snag on surrounding stationery items.

BRIEF SUMMARY OF THE INVENTION

The present invention seeks to obviate one or more of these disadvantages.

Accordingly, the present invention is directed to a cover for a binding which comprises at least one looped formation to enable it to hold together a plurality of sheets of paper and which is held on or adjacent to the inside of a spine of the cover when the latter is in use, the cover having at least one tab on or adjacent to the spine of the cover, the tab having an aperture into which such a looped formation can be inserted when the cover is in use.

Preferably, the cover is cut from a single sheet of material, preferably a plastics material, and most preferably polypropylene. In this way, the tab or tabs are created integrally with the rest of the cover.

The or each tab may extend from a side of the spine.

Alternatively, they may extend inwardly towards the spine from the front flap or the rear flap of the cover.

Most preferably, they extend towards the spine from the front flap. This provides the advantage that the front flap can lie everywhere flat against the contents of the cover.

If in addition the cover or at least the front flap thereof is transparent or translucent, printed matter at the top of the contents may be readily seen through that flap.

The spine of the cover may be flexible to enable it to be curved around such a binding. Such a cover will be capable of taking any selected one of a number of different sizes of binding. It is desirable for the spine to be capable of being wrapped around the greater part of the binding.

One way in which the spine may be made flexible is by means of multiple score-lines in the cover in the spine region thereof.

In one form of construction, the tabs may be provided on both sides of the spine to avoid the need of any other means of securing the binding to the cover.

The present invention extends to a cover with a binding which comprises at least one looped formation to hold together a plurality of sheets of paper, and which is held on the inside of the spine of the cover, the cover having at least one tab on or adjacent to the spine of the cover, the tab having an aperture through which such a looped formation extends.

The binding may comprise a loose-leaf mechanism or other means comprising one or more rings.

Alternatively, the binding may comprise a wire binding, or a plurality of discs which are each provided with a widened rim.

Alternatively, the binding may comprise a plurality of tongue-shaped members each of which is widened around its periphery and which has a base portion.

BRIEF DESCRIPTION OF THE SEVERAL VIEWS OF THE DRAWINGS

Examples of covers each made in accordance with the present invention are illustrated in the accompanying drawings, in which.

DETAILED DESCRIPTION OF THE INVENTION

Figure 1:
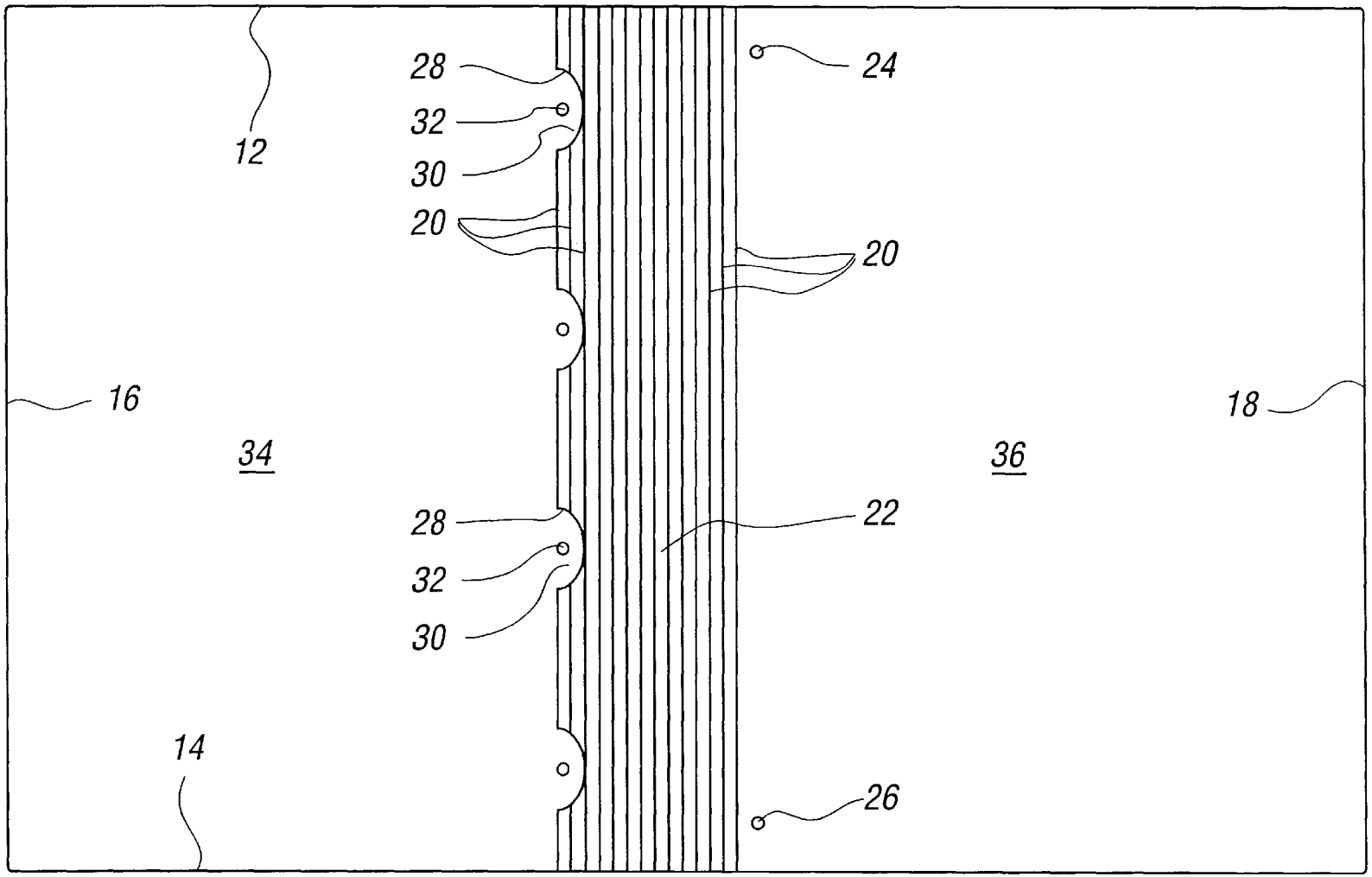
FIG. 1 shows a plan view of a blank of such a cover directly after it has been cut from a sheet of material and while it remains in a flat condition.

FIG. 1 shows a cover blank 10 cut from a single sheet of translucent polypropylene which is about 0.8 mm thick. It is generally rectangular in shape having two longer sides 12 and 14 and two shorter sides 16 and 18. It is also scored or ceased along a multiplicity of lines 20 extending along a band 22 which is generally parallel to the shorter sides 16 and 18 and which generally bisects the cover blank 10, but is slightly closer to the side 16 than it is to the side 18. Adjacent to and on one side of the band 22, the side thereof closer to the side 18, and also adjacent to the longer sides 12 and 14, respectively, are punched two apertures in the form of through-holes 24 and 26. On the other side of the band 22, there are four arcuate through-cuts 28 spaced apart along the length of the band 22. Each of these arcuate through-cuts 28 has its ends terminating on an outermost score-line 20 and extends inwardly into the band 22. Each of these arcuate through-cuts 28, therefore, defines an associated tab 30, being the region within the concavity of the arcuate through-cut. None of the score-lines 20 extends within the region of the tab, nor does the said outermost score-line extend between the ends of the through-cut 28 in this particular embodiment of the invention. A through-hole 32 is punched through each tab 30 roughly at the centre of curvature of the arc and offset slightly from the said outermost score-line 20 inwardly towards the band 22.

The region of the cover blank 10 between the band 22 and the side 16 and which extends away from the tab side of the band 22 constitutes a front flap 34 of the cover, and the region of the cover blank 10 between the band 22 and the side 18 and which extends away from the side of the band 22 on which the through-holes 24 and 26 are located, constitutes a rear flap 36 of the cover.

When the cover blank 10 is prepared for use, an elongate, loose-leaf, D-ring binder mechanism 38 having four openable looped formations in the form of D-rings 40 spaced apart therealong is secured to the cover blank 10 by means of rivets 42 which pass through holes provided for that purpose at the ends of the mechanism 38 and also through the through-holes 24 and 26 in the cover blank 10. The D-rings 40 may now be opened, and the band 22 which constitutes a spine of the cover can be folded-over by virtue of the score-lines 20 so that the now adjacent portions of the D-rings 40 can be threaded through the holes 32 of the tabs 30 respectively. The D-rings 40 can now be closed to provide the construction shown in FIGS. 2 to 7.

Figure 8:
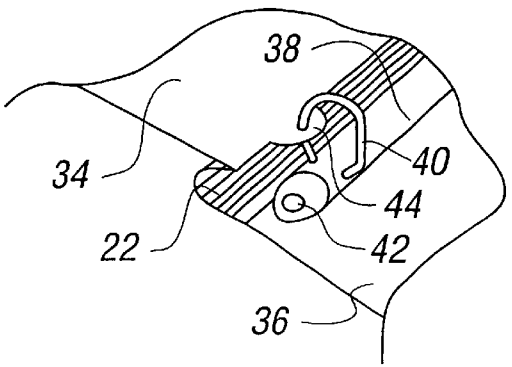
FIG. 8 shows a modification to the construction of the cover shown in FIG. 7.

It will be seen from the modification shown in FIG. 8 that flared slots 44 may be cut from each hole 32 outwardly to the outermost edge of its tab 30. Where it meets the hole 32, this slot 44 is slightly narrower than the diameter of the hole. This enables the tab 30 to be engaged with its associated D-ring 40 without the need to thread a part of the latter through the hole 32. Instead, the tab 30 can simply be pushed towards the associated D-ring 40 while the latter is still closed so that a portion of that ring is guided into the slot 44 and ultimately snaps into the hole 32 where it is retained.

Figure 2:
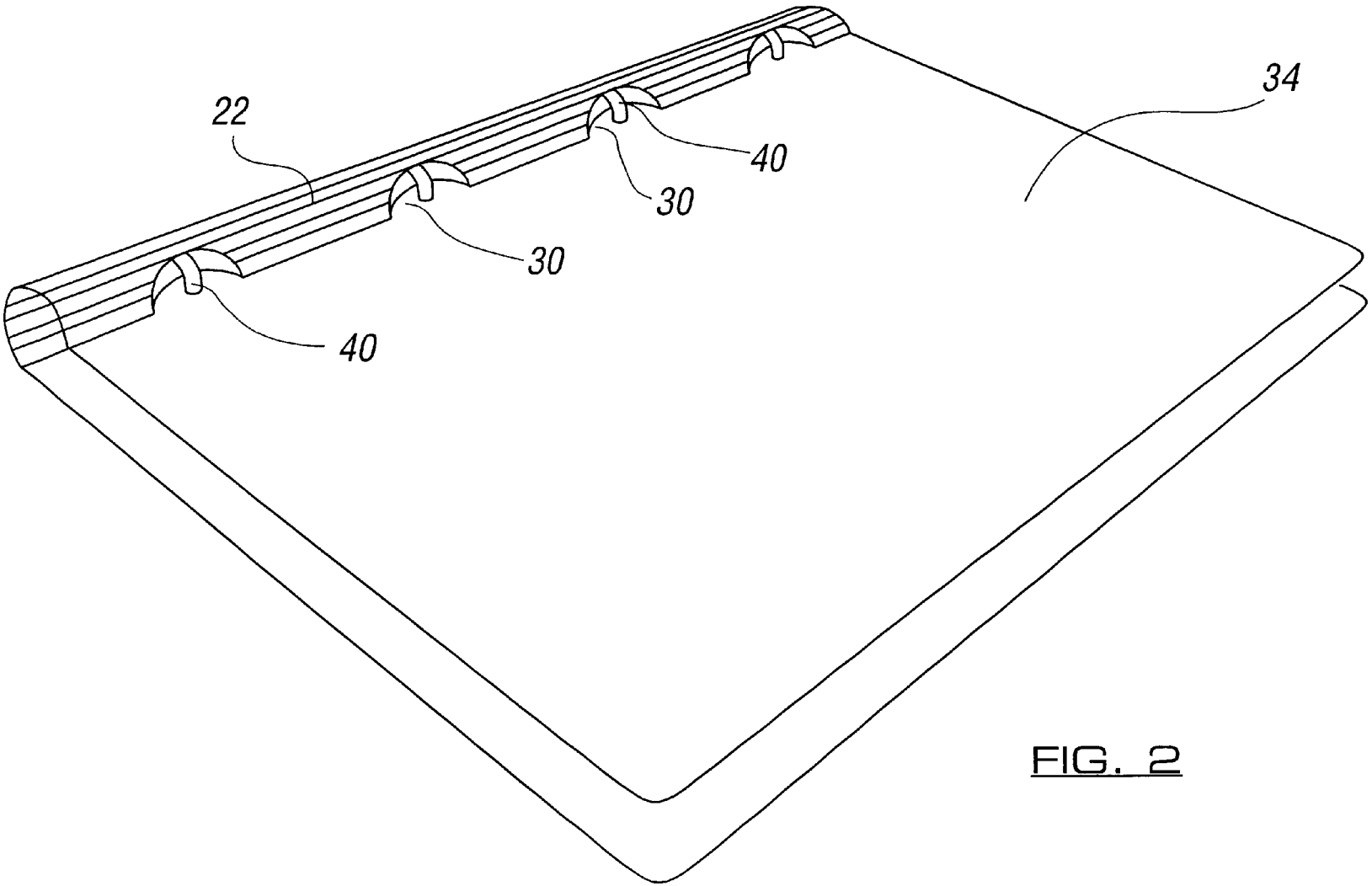
FIG. 2 is a perspective view of the cover from above in a folded-over condition, a binding having been secured to the cover.
Figure 6:
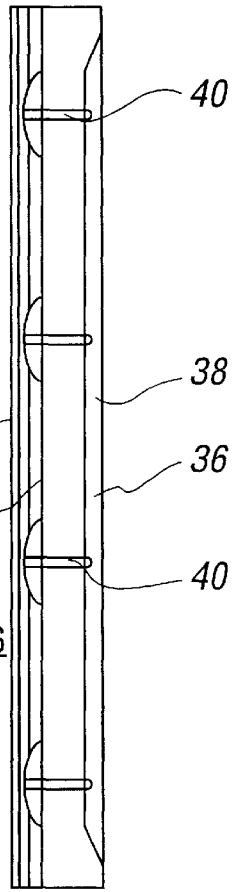
FIGS. 3, 4, 5 and 6 show front, bottom, and offset side views of the cover and binding assembly shown in FIG. 2.
Figure 4:
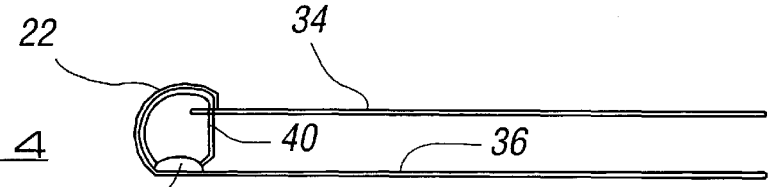
Figure 3:
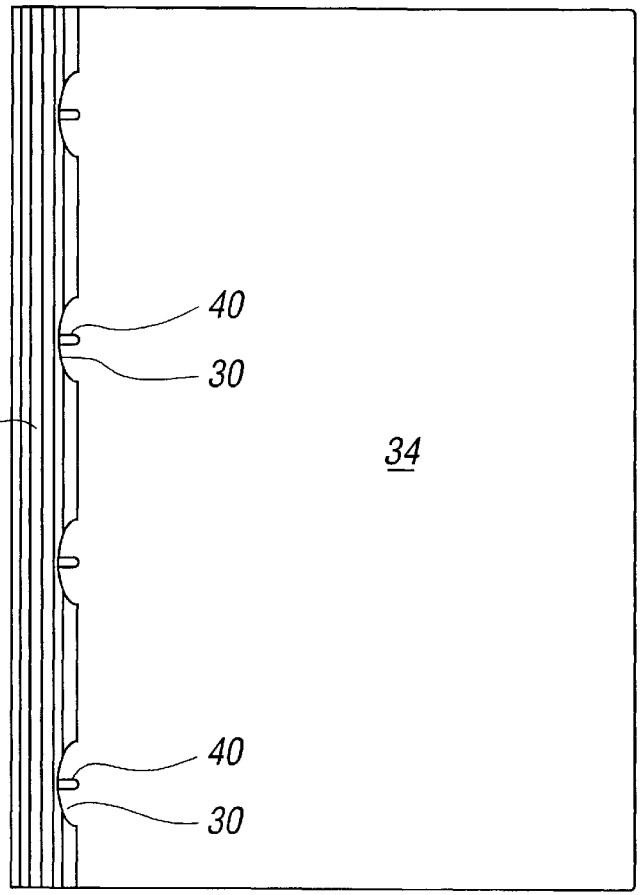
Figure 5:
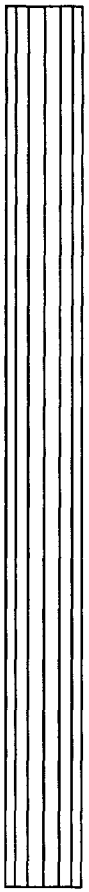
Figure 7:
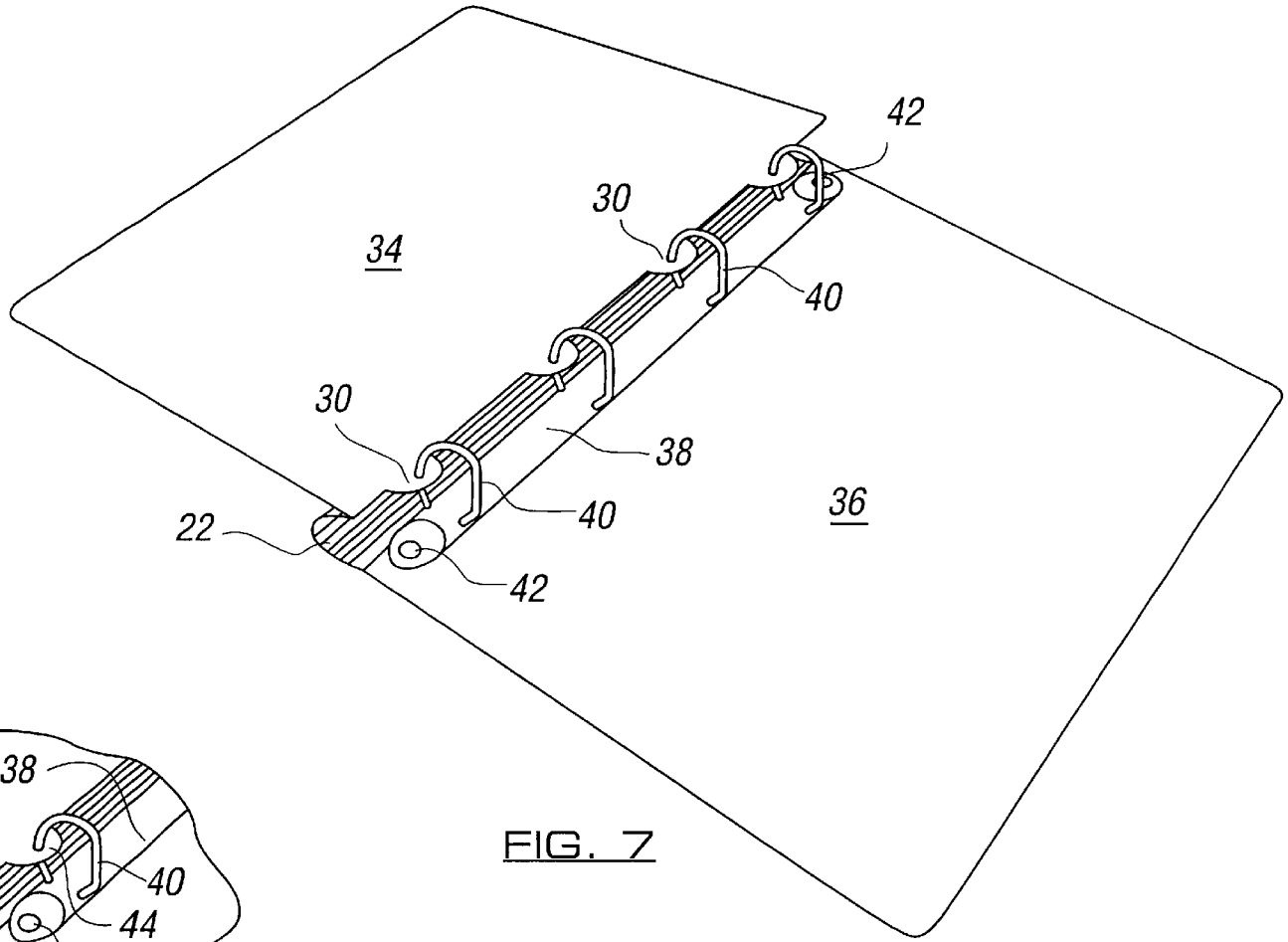
FIG. 7 shows a perspective view from above of the cover and binding of FIG. 2 in an open condition.
Figure 9:
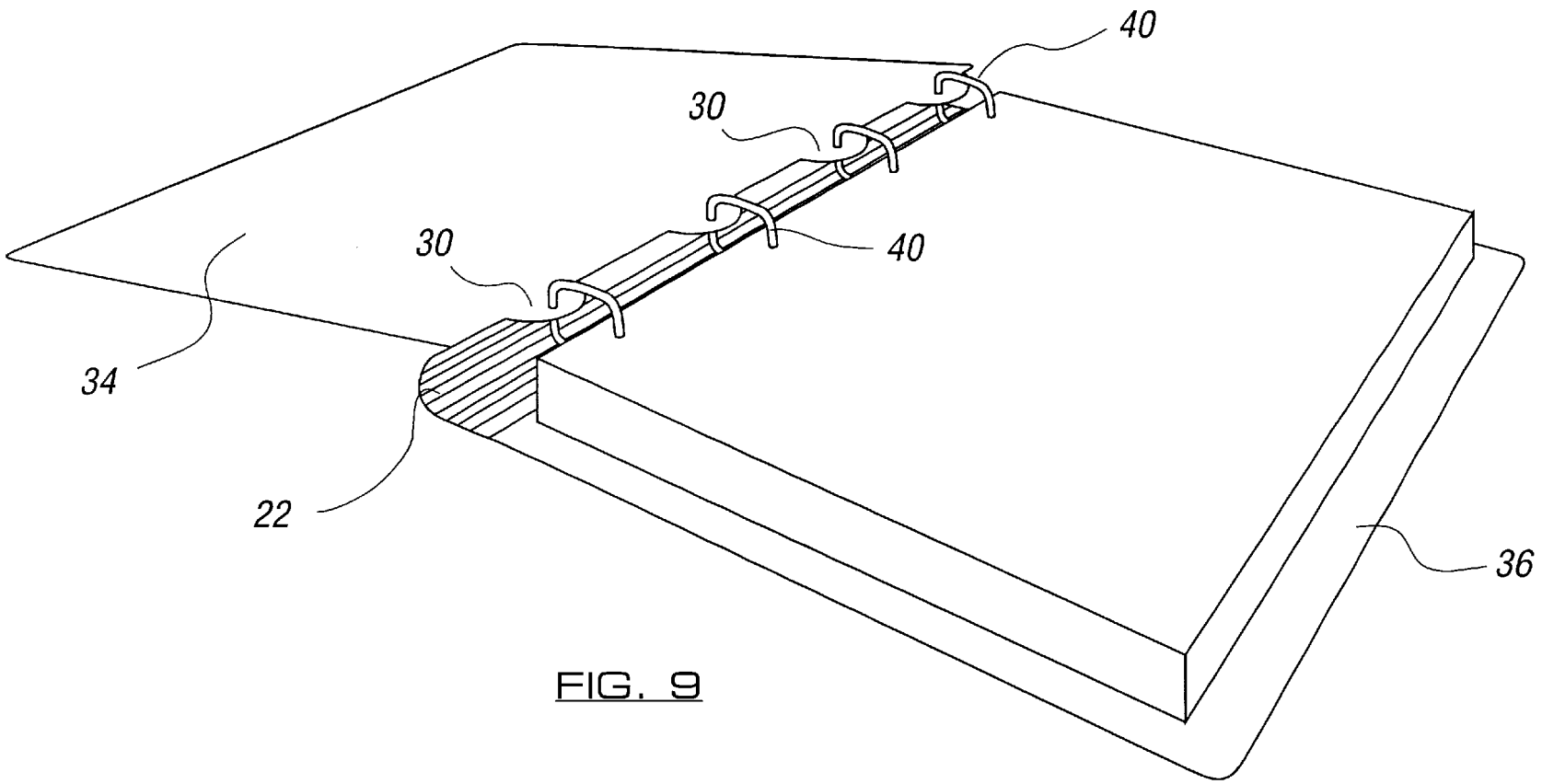
FIG. 9 shows a perspective view from above of the cover shown in FIGS. 2 to 7, further provided with a sheet of papers held by the binding.
Figure 10:
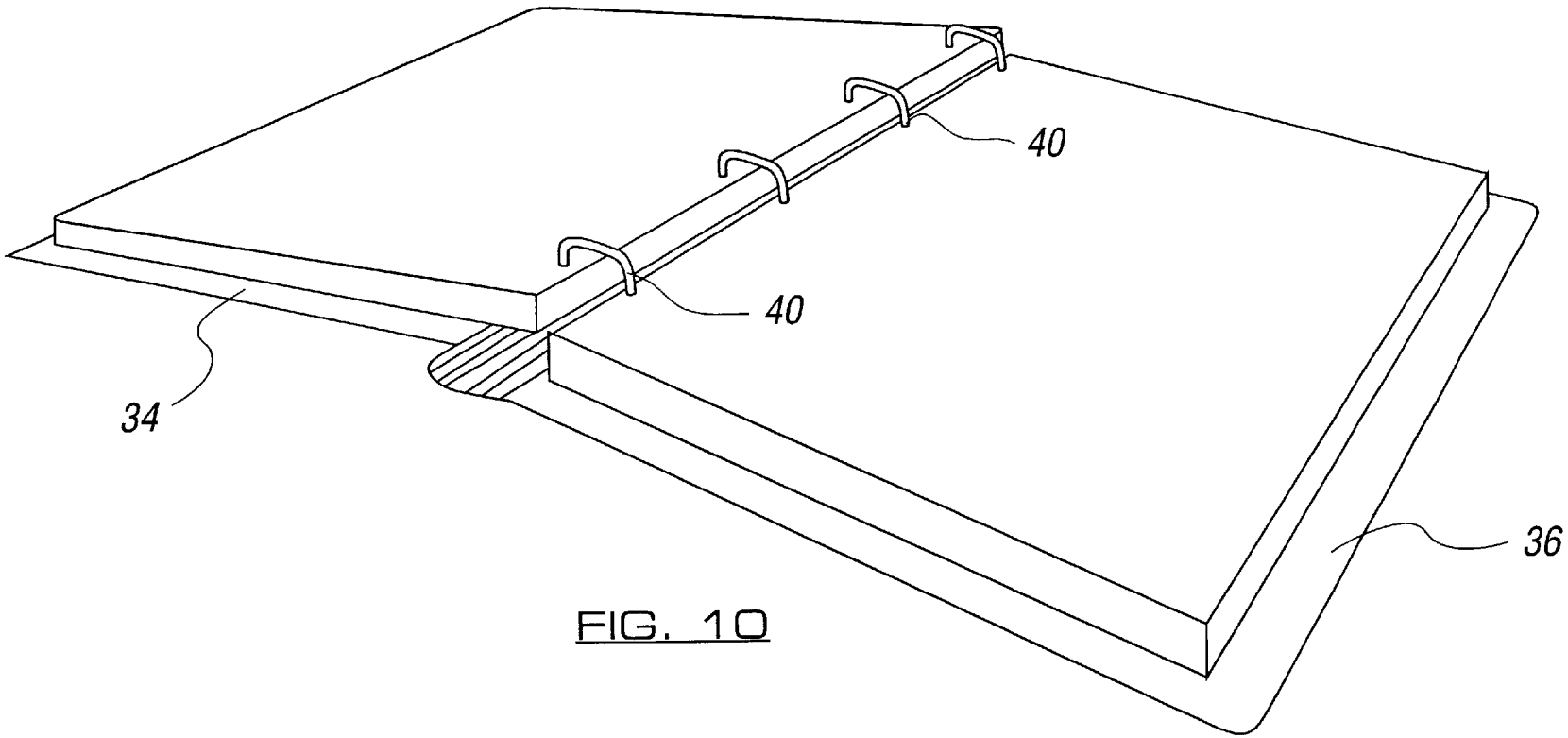
FIG. 10 shows a further perspective view of the cover and contents shown in FIG. 9 but with some of the sheets thereof turned over.

With the binding and cover assembly as shown in FIG. 7, the D-rings 40 may be opened and a multiplicity of sheets of paper each with punched holes along its margin may be inserted in the conventional manner into the cover so that it is held by the D-rings as shown in FIG. 9. As pages are turned over, it will be seen that the weight of the paper presses the front flap 34 downwardly owing to the resilience of the flexible spine constituted by the band 22 so that the two surfaces of paper on view are maintained broadly at the same level. When the cover is closed as shown in FIG. 2, it will be seen that the front flap 34 can rest flat against the uppermost sheet of paper on all points thereof. This provides the advantage, that if the polypropylene material from which the cover has been cut is transparent or translucent, any printing on the uppermost surface of paper is clearly visible on all points on that surface.

Figure 11:
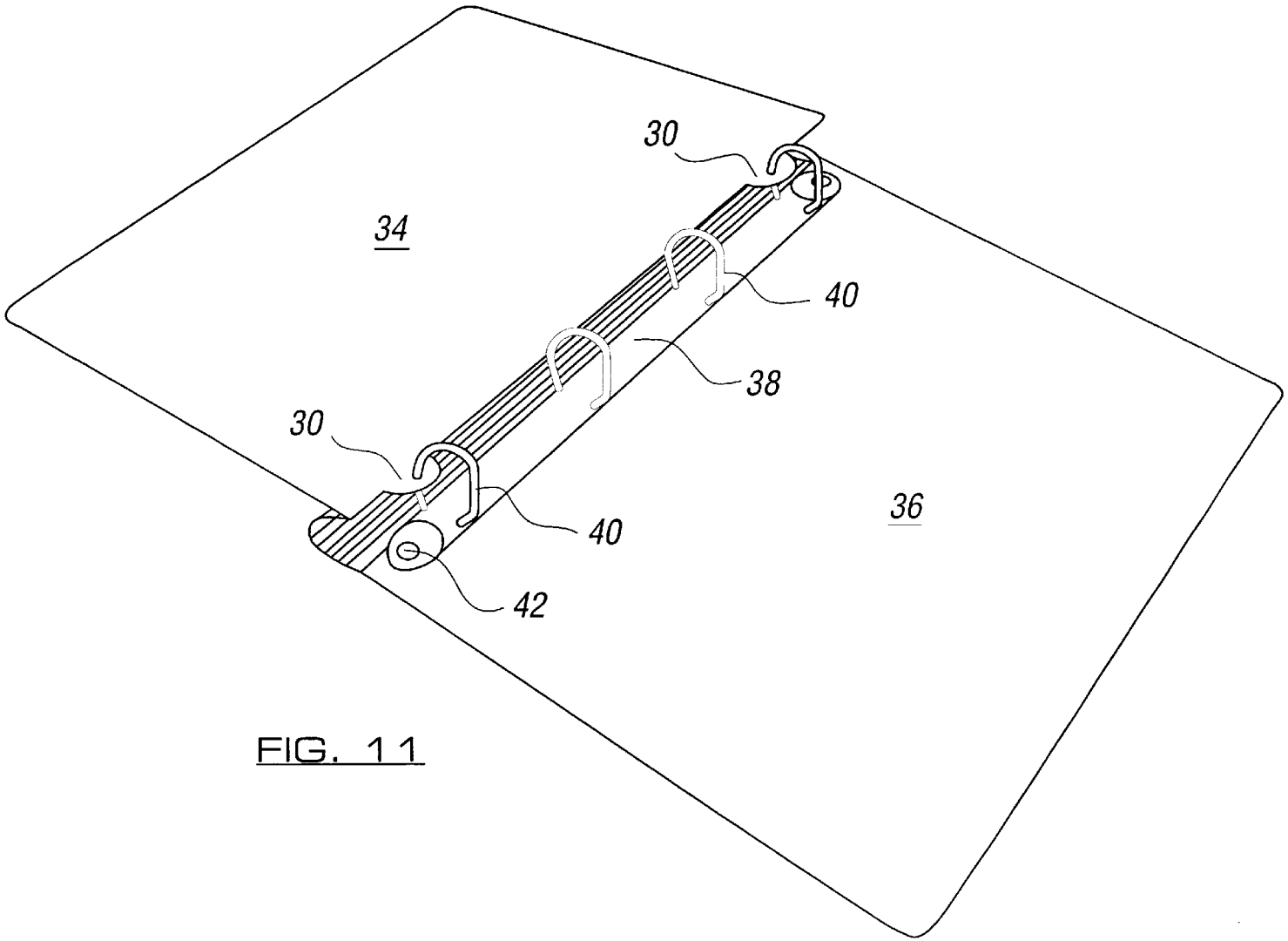
FIG. 11 shows a perspective view from above of a modified form of the cover and binding shown in FIGS. 2 to 7.

In the modification shown in FIG. 11, it can be seen that there are only two tabs 30 engaging the outermost D-rings 40. No tabs have been cut for the two innermost D-rings of the mechanism 38.

Figure 12:
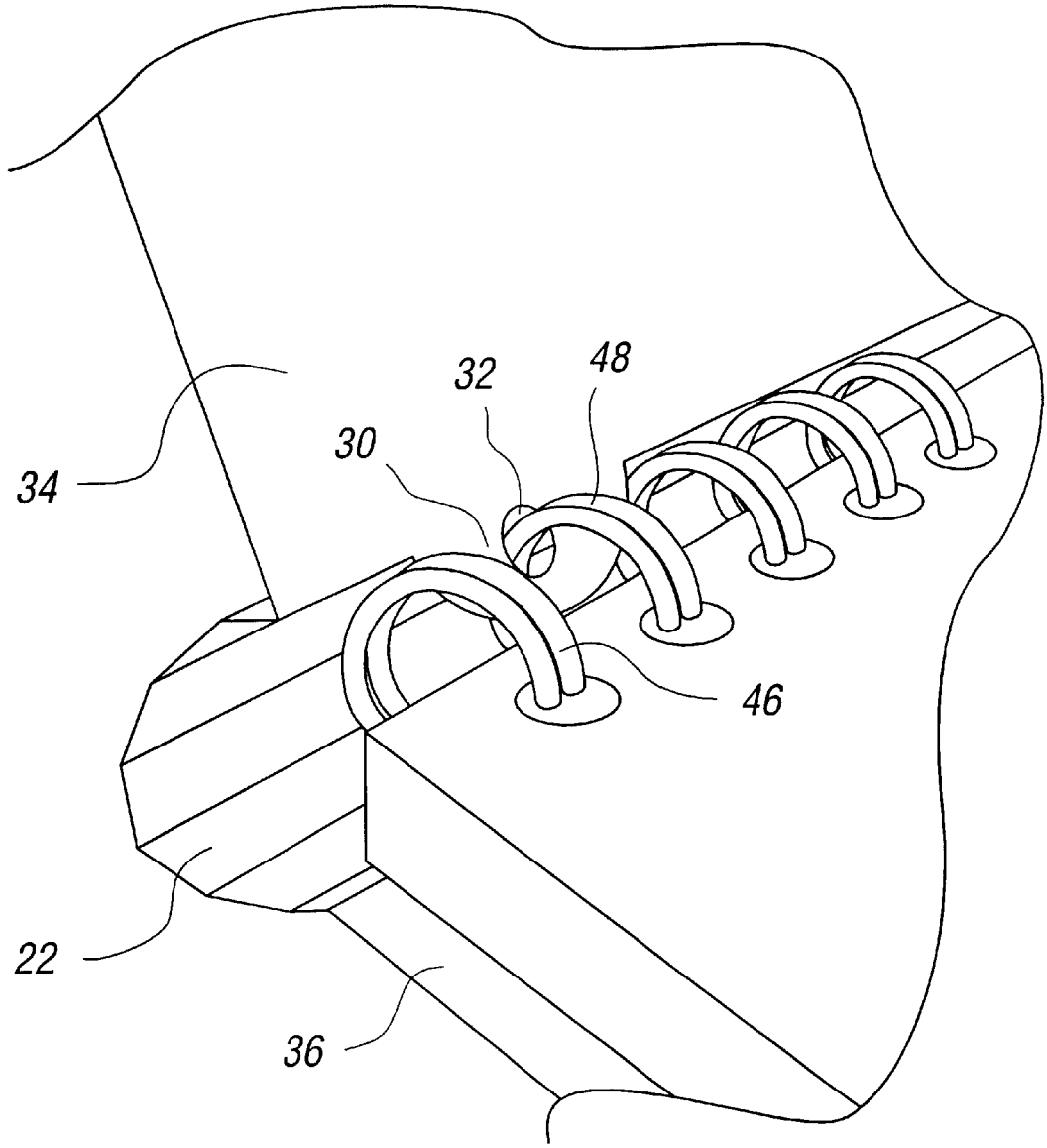
FIG. 12 shows, on a larger scale, a perspective view of parts of a cover embodying the present invention with a binding different from the one shown in FIGS. 2 to 7.

In the modification shown in FIG. 12, it can be seen that the mechanism 38 has been replaced by a continuous looped wire binding 46. In this case one or more loops 48 of wire pass through the hole 32 on each tab 30.

Figure 13:
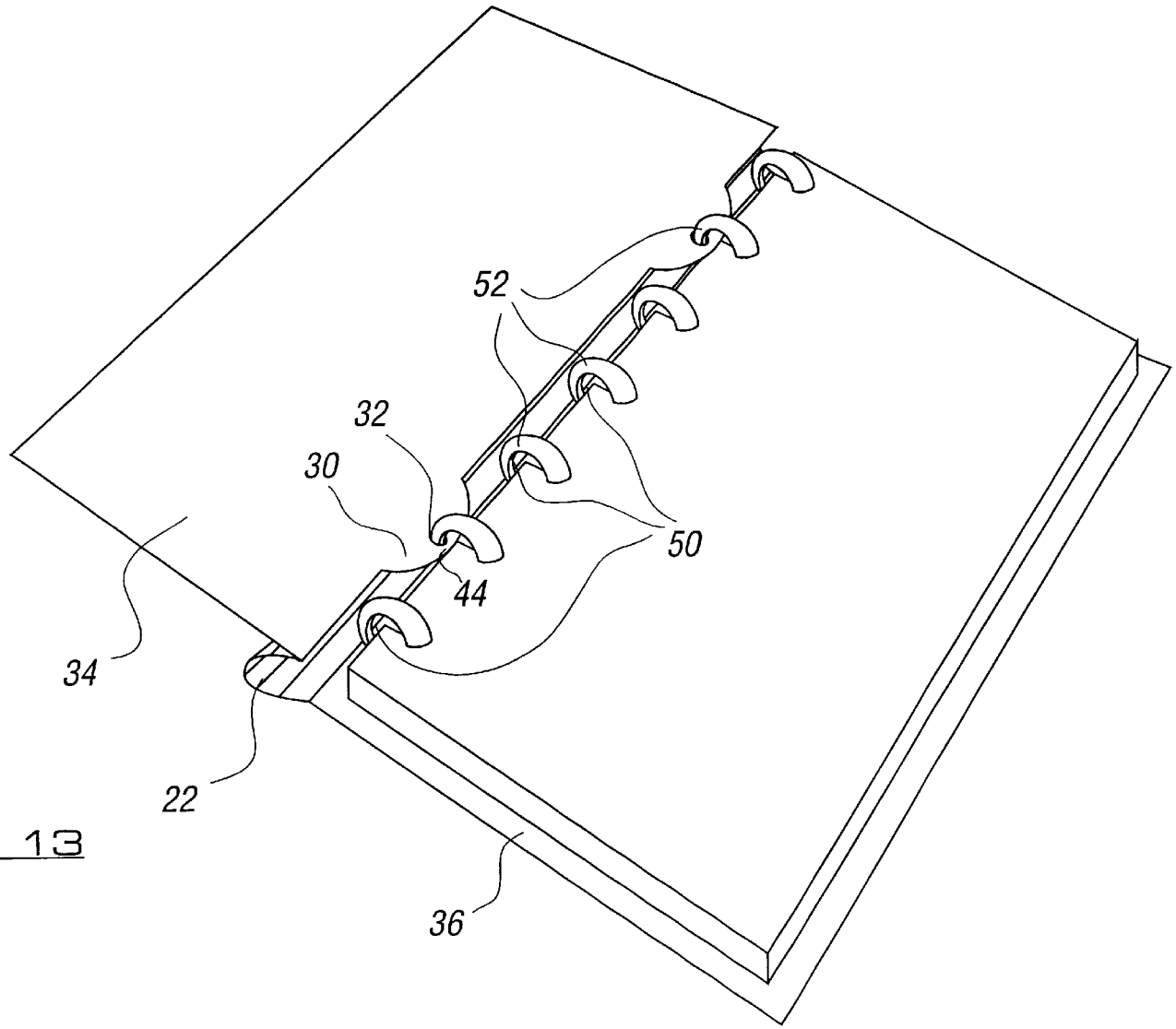
FIG. 13 shows a perspective view from above of a cover made in accordance with the present invention with a modified form of binding.
Figure 15:
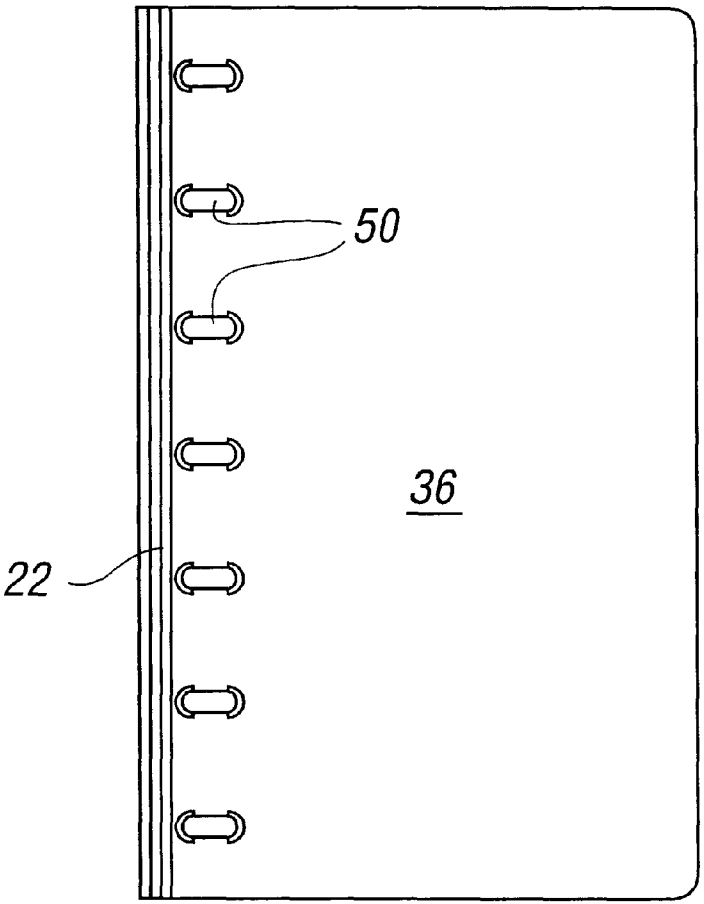
FIGS. 14 and 15 show a rear face of the cover shown in FIG. 13, FIG. 14 with the binding removed and FIG. 15 with the binding in place.
Figure 14:
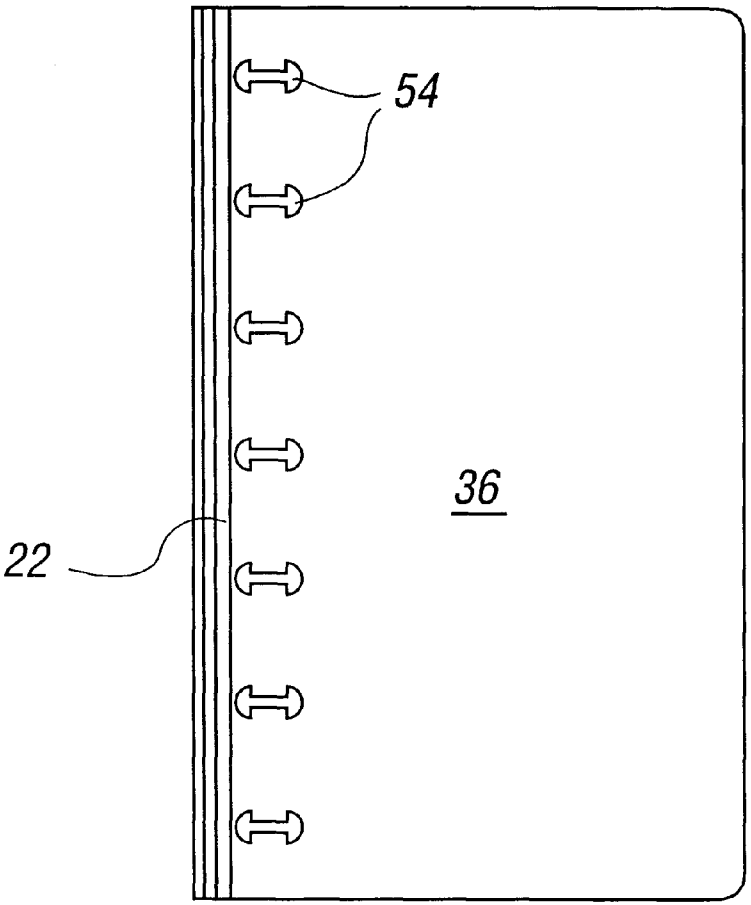

In the modification shown in FIG. 13, the mechanism 38 has been replaced by a binding constituted by a plurality of discs 50 each having a broadening periphery 52. In this case, the aperture constituted by a slot 44 as well as a hole 32, as shown for example in FIG. 8 is used. Furthermore, each disc 50 is secured to the rear flap 36 of the cover by way of dumbbell-shaped slots 54 through which the discs 50 extend.

Figure 16:
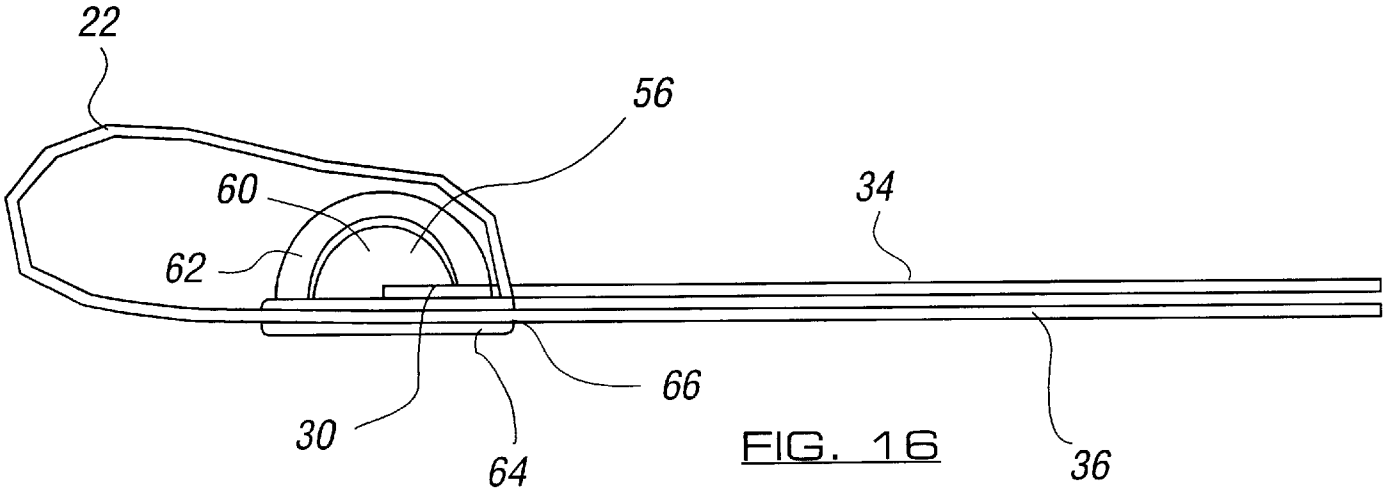
FIG. 16 shows an end view of a cover made in accordance with the present invention with a different construction of binding.
Figure 17:
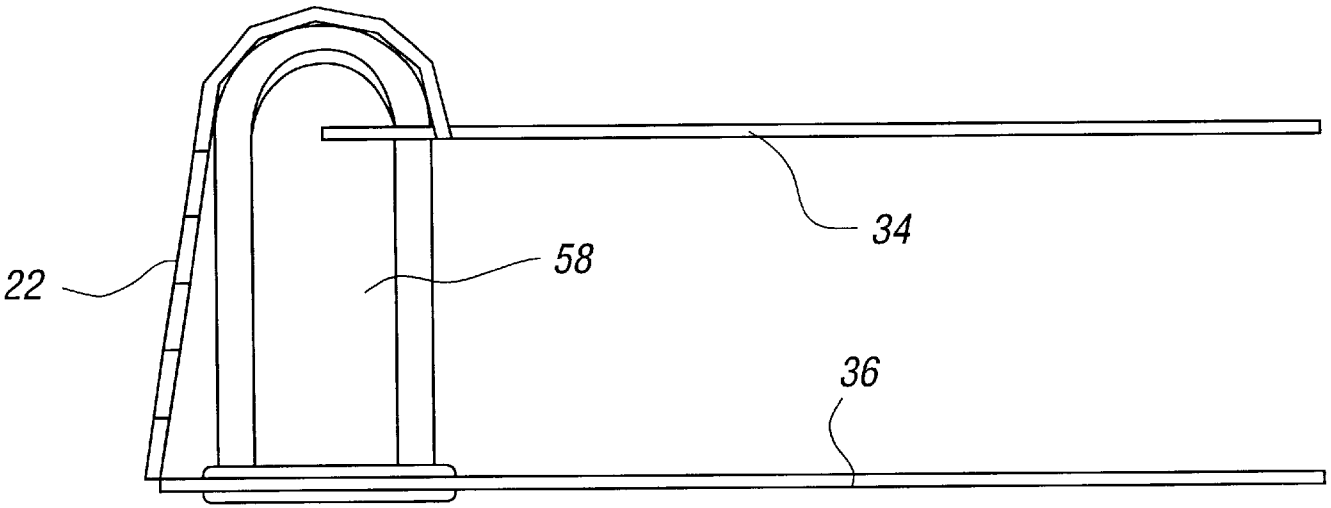
FIG. 17 shows an end view of the cover shown in FIG. 16 with a binding having the same general construction as the one shown in FIG. 16, but being of a larger size.

In the modification shown in FIGS. 16 and 17, the mechanism 38 is replaced by a plurality of binding devices 56 or 58. Each of these comprises a tongue-shaped portion 60 having a widened periphery 62 and a base 64 which is formed with a groove 66 into which is slid the edges of slots (not shown) cut in the rear flap 36 of the cover. In this case, the band 22 would be located such that the front flap 34 is much less wide than the rear flap 36.

By virtue of the flexibility of the band 22 which constitutes the spine of the cover, different heights of binding devices 56 or 58 can be accommodated by the spine, as shown in FIGS. 16 and 17, so that the same cover can be used for binders of different capacity.

Figure 18:
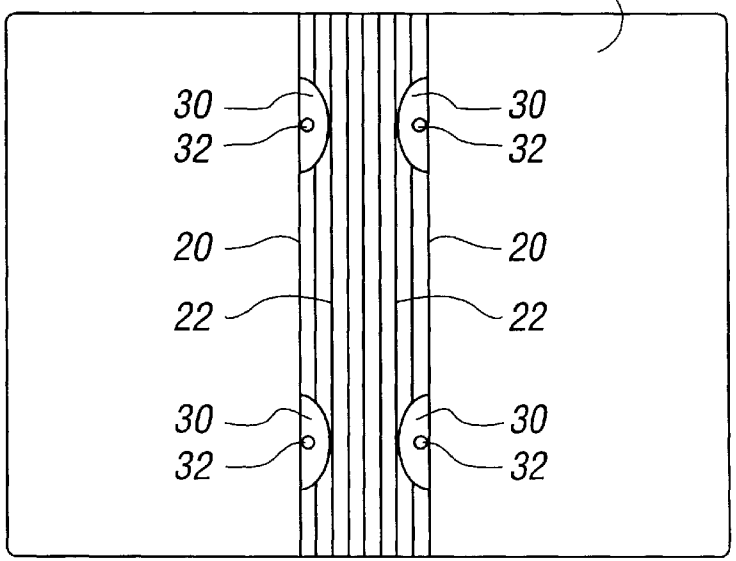
FIG. 18 shows a plan view of a blank of a modified cover made in accordance with the present invention.
Figure 19:
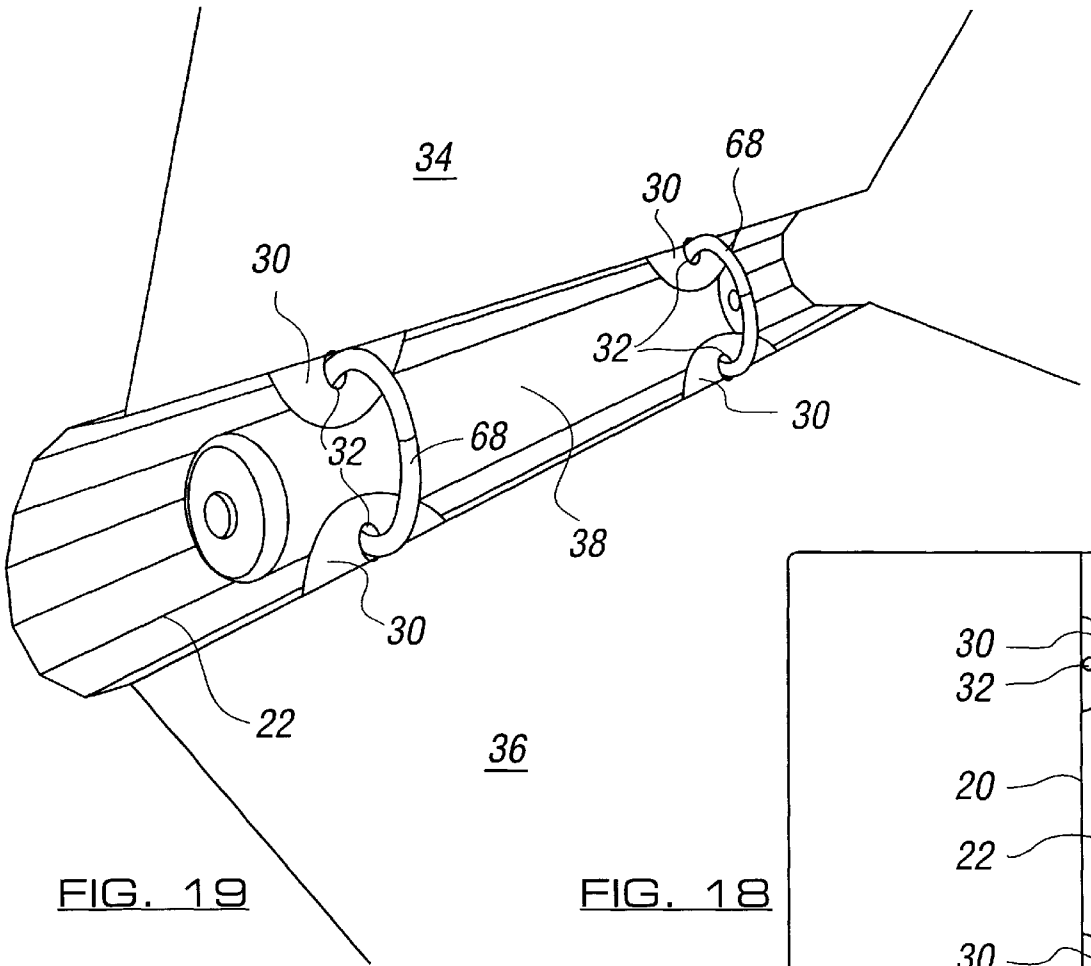
FIG. 19 shows a perspective view of the cover shown in FIG. 18, slightly closed with a first construction of binding.

In the modification shown in FIGS. 18 and 19, the band 22 is located substantially centrally in the cover blank 10, and tabs 30 are cut on both sides of the band 22. With a loose-leaf binding mechanism 38 having each of its rings 68 passing through the holes 32 of a pair of opposing tabs 30, there is no need for the mechanism 38 to be riveted to the cover.

Figure 20:
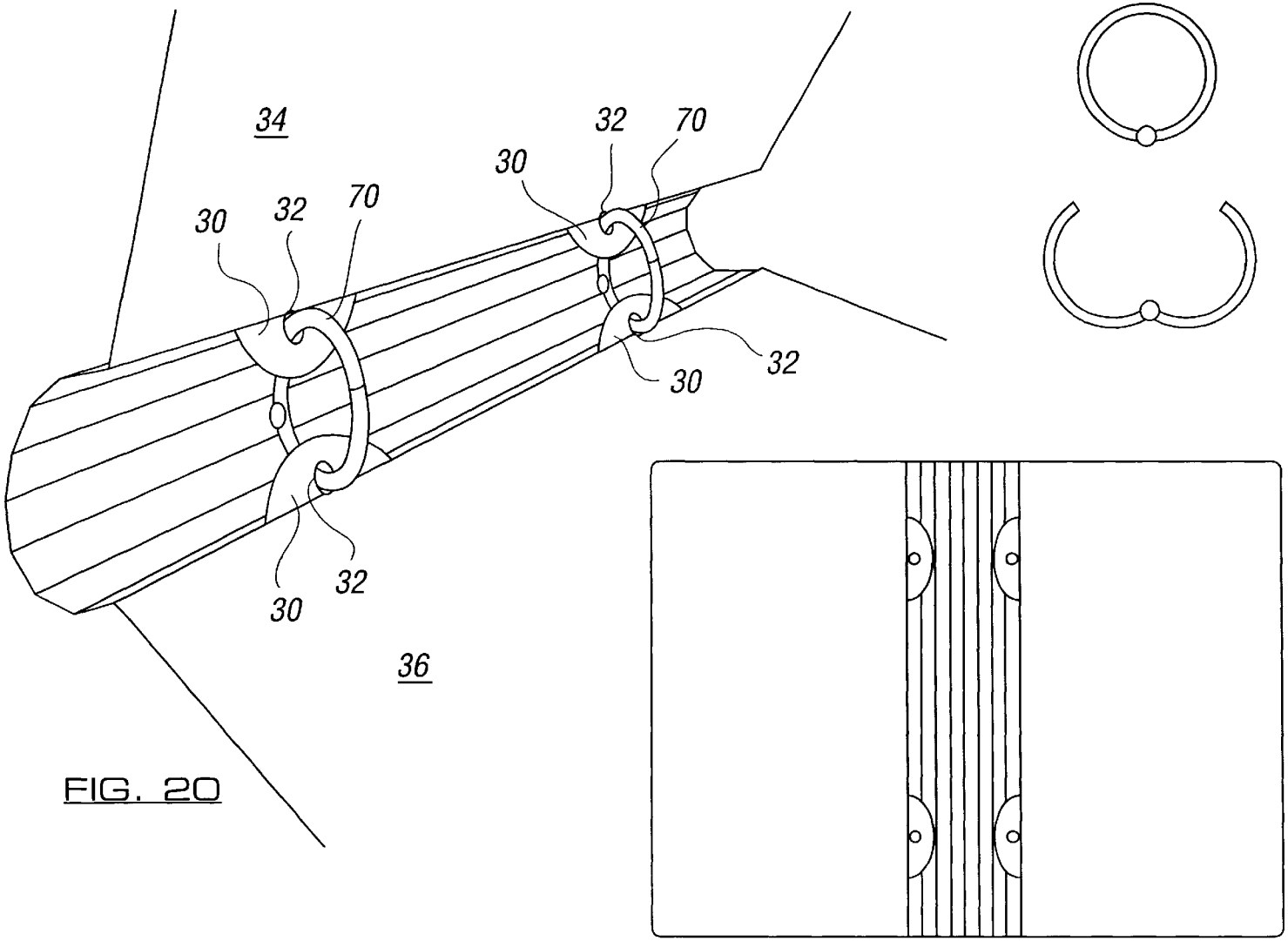
FIG. 20 shows a perspective open view of the cover shown in FIG. 18 with a second construction of binding.

In the modification shown in FIG. 20, the mechanism 38 is replaced by separate openable rings 70 avoiding the need for any connecting element between those two rings.

For the embodiments shown in FIGS. 18 to 20, the outermost score-lines 20 do extend between the ends of the arcuate through-cuts 28, to enable the tabs 30 to flex relative to their adjacent flap, to facilitate the engagement of the latter with the ring 68 or the ring 70.

Figure 21:
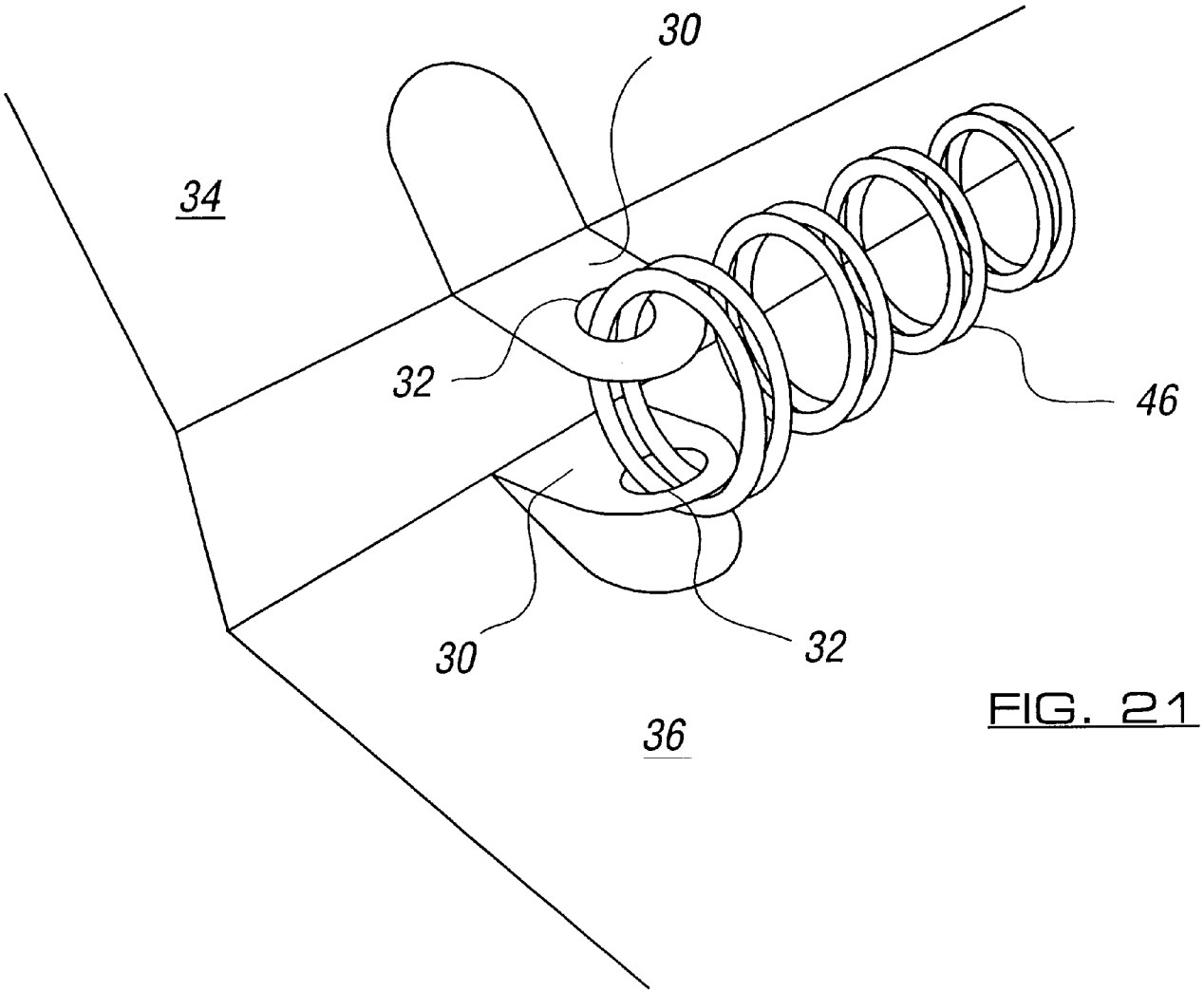
FIG. 21 shows a perspective view of yet a further construction of cover made in accordance with the present invention.

In the modification shown in FIG. 21, the mechanism 38 is replaced by a looped continuous wire binding 46, the band 22 is replaced by nothing more than two score-lines 20 corresponding to the outermost score-lines in the construction shown in FIG. 1, and the tabs 30 are cut so as to extend outwardly away from the spine 22.

We claim:

1. A cover for a binding which comprises at least one looped formation to enable it to hold together a plurality of sheets of paper and which is held on or adjacent to the inside of a spine of the cover when the latter is in use, wherein the cover has at least one through-cut defining a tab on or adjacent to the spine of the cover, so that said at least one tab is created integrally with the rest of the cover, the tab having an aperture into which said at least one looped formation is inserted when the cover is in use.

2. A cover according to claim 1, wherein the sheet of material is a sheet of plastics material.

3. A cover according to claim 2, wherein the sheet of material is a sheet of polypropylene.

4. A cover according to claim 1, wherein said at least one tab extends from a side of the spine.

5. A cover according to claim 1, wherein said at least one tab extends inwardly towards the spine from a flap of the cover.

6. A cover according to claim 5, wherein said at least one tab extends inwardly towards the spine from a front flap of the cover.

7. A cover according to claim 1, wherein at least a front flap of the cover is transparent or translucent.

8. A cover according to claim 1, wherein the spine of the cover is flexible to enable it to be curved around such a binding, to enable the cover to take any selected one of a number of different sizes of binding.

9. A cover according to claim 1, wherein the spine is capable of being wrapped around the greater part of such a binding.

10. A cover according to claim 1, wherein the spine is made flexible by means of multiple score-lines in the cover in the spine region thereof.

11. A cover according to claim 1, wherein tabs are provided on both sides of the spine to avoid the need of any other means of securing such a binding to the cover.

12. A cover with a binding which comprises at least one looped formation to hold together a plurality of sheets of paper, and which is held on the inside of the spine of the cover, the cover having at least one through-cut defining a tab on or adjacent to the spine of the cover, so that said at least one tab is created integrally with the rest of the cover, the tab having an aperture through which such a looped formation extends.

13. A cover according to claim 12, wherein the binding comprises means comprising one or more rings.

14. A cover according to claim 12, wherein the binding comprises a wire binding.

15. A cover according to claim 12, wherein the binding comprises a plurality of discs which are each provided with a widened rim.

16. A cover according to claim 12, wherein the binding comprises a plurality of tongue-shaped members each of which is widened around its periphery and which has a base portion.

* * * * *